US010911878B2

(12) United States Patent
Higgins et al.

(10) Patent No.: US 10,911,878 B2
(45) Date of Patent: Feb. 2, 2021

(54) MODULARIZATION OF COMPONENTS OF AN EAR-WEARABLE DEVICE

(71) Applicant: Starkey Laboratories, Inc., Eden Prairie, MN (US)

(72) Inventors: Sidney A. Higgins, Maple Grove, MN (US); Scott Timmerman, Buffalo, MN (US); Dustin Degen, Waconia, MN (US); Jodi Rickheim, Stewart, MN (US); Brian Dahl, Minnetrista, MN (US); Christopher Frank Filo, Shakopee, MN (US); Kenneth Duane Gjerde, Jr., White Bear Lake, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 16/230,024

(22) Filed: Dec. 21, 2018

(65) Prior Publication Data

US 2020/0204933 A1 Jun. 25, 2020

(51) Int. Cl.

| | |
|---|---|
| ***H04R 1/02*** | (2006.01) |
| ***H04R 25/00*** | (2006.01) |
| ***H04R 1/10*** | (2006.01) |

(52) U.S. Cl.

CPC ..... *H04R 25/604* (2013.01); *H04R 1/1066* (2013.01); *H04R 1/1075* (2013.01); *H04R 25/652* (2013.01); *H04R 2225/0213* (2019.05); *H04R 2225/77* (2013.01)

(58) Field of Classification Search

CPC combination set(s) only.
See application file for complete search history.

(56) References Cited

U.S. PATENT DOCUMENTS

| | | | |
|---|---|---|---|
| 5,204,917 | A | 4/1993 | Arndt |
| 5,253,300 | A | 10/1993 | Knapp |
| 5,565,759 | A | 10/1996 | Dunstan |
| 7,106,877 | B1 | 9/2006 | Linville |
| 7,110,562 | B1 | 9/2006 | Feeley et al. |
| 7,151,839 | B2 | 12/2006 | Niederdrank |
| 7,565,179 | B2 | 7/2009 | Hyatt |

(Continued)

FOREIGN PATENT DOCUMENTS

| | | | |
|---|---|---|---|
| DE | 8804743 | U1 | 9/1989 |
| DE | 102009033898 | B3 | 11/2010 |

(Continued)

OTHER PUBLICATIONS

U.S. Appl. No. 16/135,712, filed Sep. 19, 2018, by Solum et al.

(Continued)

*Primary Examiner* — Amir H Etesam
(74) *Attorney, Agent, or Firm* — Mueting Raasch Group

(57) ABSTRACT

An ear-wearable device is described that includes a plurality of modules that mate together forming a physical outer shell of the ear-wearable device. Each module from the plurality of modules is associated with a different, corresponding feature of the ear-wearable device and each module from the plurality of modules includes a respective physical portion that comprises a different, corresponding part of the outer shell. In addition, each module from the plurality of modules shares a physical interface with at least one other module from the plurality of modules.

26 Claims, 10 Drawing Sheets

(56) References Cited

U.S. PATENT DOCUMENTS

| | | | | |
|---|---|---|---|---|
| 8,169,938 | B2 | 5/2012 | Duchscher et al. | |
| 8,848,958 | B2 | 9/2014 | Karlsen | |
| 9,124,994 | B2 | 9/2015 | Corti et al. | |
| 9,338,561 | B2 | 5/2016 | Gran et al. | |
| 9,380,106 | B2 | 6/2016 | Payne et al. | |
| 9,543,778 | B1 | 1/2017 | Corti | |
| 9,788,130 | B2 | 10/2017 | Müller | |
| 9,900,680 | B2 | 2/2018 | Milam et al. | |
| 9,980,033 | B2 | 5/2018 | Boesen | |
| 10,306,381 | B2 | 5/2019 | Sandhu et al. | |
| 10,516,281 | B2 | 12/2019 | Dennis | |
| 2009/0262964 | A1 | 10/2009 | Havenith et al. | |
| 2012/0041517 | A1 | 2/2012 | Walsh et al. | |
| 2012/0140963 | A1 | 6/2012 | Larsen et al. | |
| 2013/0034584 | A1 | 2/2013 | Cichon | |
| 2013/0294627 | A1 | 11/2013 | Karlsen | |
| 2013/0343584 | A1 | 12/2013 | Bennett et al. | |
| 2013/0343585 | A1 | 12/2013 | Bennett et al. | |
| 2014/0156775 | A1 | 6/2014 | Payne et al. | |
| 2014/0254845 | A1 | 9/2014 | Hastrup | |
| 2015/0036835 | A1 | 2/2015 | Chen | |
| 2015/0181357 | A1 | 6/2015 | Krystek et al. | |
| 2015/0341730 | A1 | 11/2015 | Pedersen et al. | |
| 2015/0350797 | A1* | 12/2015 | Muller ..... | H04R 25/602 381/323 |
| 2016/0006292 | A1 | 1/2016 | Hatanaka et al. | |
| 2016/0058093 | A1 | 3/2016 | Kennard et al. | |
| 2016/0100261 | A1 | 4/2016 | Shennib | |
| 2017/0064429 | A1 | 3/2017 | Hirsch et al. | |
| 2017/0094390 | A1 | 3/2017 | Chawan et al. | |
| 2017/0195804 | A1 | 7/2017 | Sandhu et al. | |
| 2017/0289711 | A1 | 10/2017 | Maas | |
| 2018/0014109 | A1 | 1/2018 | Boesen | |
| 2018/0020295 | A1 | 1/2018 | Pander et al. | |
| 2018/0027343 | A1 | 1/2018 | Dobson et al. | |
| 2018/0124491 | A1 | 5/2018 | Dragicevic et al. | |

FOREIGN PATENT DOCUMENTS

| | | |
|---|---|---|
| EP | 2849462 A1 | 3/2015 |
| EP | 3035710 | 11/2016 |
| EP | 3101917 A1 | 12/2016 |

OTHER PUBLICATIONS

U.S. Appl. No. 16/135,784, filed Sep. 19, 2018, by Solum et al.
U.S. Appl. No. 16/135,829, filed Sep. 19, 2018, by Solum et al.
U.S. Appl. No. 16/135,867, filed Sep. 19, 2018, by Solum et al.
Cho et al., "A 10.8 mW Body Channel Communications/MIGS Dual-Band Transceiver for a Unified Body Sensor Network Controller," IEEE Journal of Solid-Slate Circuits, vol. 44, No. 12, Dec. 2009, pp. 3459-3468.
Hao et al., "Wireless body sensor networks for health-monitoring applications," Physiological Measurement, vol. 29, No. 11, Nov. 2008., 42 pp.
International Search Report and Written Opinion of International Application No. PCT/US2019/019649, dated Jul. 5, 2019, 19 pp.
International Search Report and Written Opinion of International Application No. PCT/US2019/019653, dated May 3, 2019, 13 pp.
International Search Report and Written Opinion of International Application No. PCT/US2019/019657, dated Jun. 16, 2019, 16 pp.
International Search Report and Written Opinion of International Application No. PCT/US2019/019659, dated Jun. 24, 2019, 18 pp.
Invitation to Restrict or Pay Additional Fees, from International Application No. PCT/US2019/019649, dated May 3, 2019, 14 pp.
Invitation to Restrict or Pay Additional Fees, from International Application No. PCT/US2019/019657, dated Apr. 30, 2019, 11 pp.
Invitation to Restrict or Pay Additional Fees, from International Application No. PCT/US2019/019659, dated Apr. 29, 2019, 12 pp.
Majumder et al., "Wearable Sensors for Remote Health Monitoring," Sensors, vol. 1, No. 130, Jan. 12, 2017, 45 pp.
File History for U.S. Appl. No. 16/135,712.
File History for U.S. Appl. No. 16/135,784.
File History for U.S. Appl. No. 16/135,829.
File History for U.S. Appl. No. 16/135,867.
File History for U.S. Appl. No. 16/289,078.

* cited by examiner

MODULARIZATION OF COMPONENTS OF AN EAR-WEARABLE DEVICE

TECHNICAL FIELD

This disclosure relates to ear-wearable devices.

BACKGROUND

An ear-wearable device is a device designed to be worn on or in a user's ear. Example types of ear-wearable devices include hearing aids, earphones, earbuds, telephone earpieces, and other types of devices designed to be worn on or in a user's ear.

Some ear-wearable device manufacturers introduce new ear-wearable devices to market as part of a family of products consisting of various styles, feature sets, power levels, or other characteristics. Each ear-wearable device in a family may be designed separately, incurring its own engineering, manufacturing, and regulatory costs, even though multiple ear-wearable devices in the family overlap in some aspects of form, fit, or function. For example, one ear-wearable device in a family of ear-wearable devices may be nearly identical to another ear-wearable device in the family, but for slight differences in finish, style, gain level, or feature sets. Customers may be forced to choose between one ear-wearable device configuration in a family and another ear-wearable device configuration in the family, even though both ear-wearable device configurations may have desirable but slightly different features. An ear-wearable device manufacturer that introduces families of ear-wearable device in this way may therefore incur some redundant design, engineering, manufacturing, and/or regulatory costs and unnecessarily limit consumer choice.

SUMMARY

In general, this disclosure describes ways to modularize components of an ear-wearable device for customizing and tailoring the ear-wearable device for a particular user or user type. An example ear-wearable device may be fashioned from a plurality of self-contained modules. Each self-contained module may contain a unique set of electronics, transducers, transducer interfaces, or other components and serves a specific technical purpose for the ear-wearable device. In addition, each self-contained module may form part of the external structure or shell of the ear-wearable device. That is, when mated together, the plurality of self-contained modules create an outer shell for a customized ear-wearable device that has physical and functional characteristics that are attributed to the collection of self-contained modules used to create the ear-wearable device.

In one example, an ear-wearable device is described that includes: a plurality of modules that mate together forming a physical outer shell of the ear-wearable device, wherein: each module from the plurality of modules is associated with a different, corresponding feature of the ear-wearable device; each module from the plurality of modules includes a respective physical portion that comprises a different, corresponding part of the outer shell; and each module from the plurality of modules shares a physical interface with at least one other module from the plurality of modules.

In another example, a hearing device is described that includes: a plurality of modules that mate together forming a physical outer shell of the hearing device, wherein: a first module from the plurality of modules comprises at least one microphone; a second module from the plurality of modules comprises at least one processor; a third module from the plurality of modules comprises a behind-the-ear transducer configured to couple the third module to an in-the-ear component of the hearing device, or is configured to communicate with an in-the-ear transducer of the hearing device; each module from the plurality of modules includes a respective physical portion that comprises a different, corresponding part of the outer shell; and each module from the plurality of modules shares a physical interface with at least one other module from the plurality of modules.

In another example, a method is described that includes: identifying, by a processor of a first module from a plurality of modules of an ear-wearable device, each other module from the plurality of modules; adjusting, by the processor, one or more settings of the ear-wearable device based on characteristics of each of the other modules; detecting, by the processor, at least one module from the plurality of modules being replaced with a new module; and automatically adjusting, by the processor, the one or more settings of the ear-wearable device based on characteristics of the new module.

The details of one or more aspects of the disclosure are set forth in the accompanying drawings and the description below. Other features, objects, and advantages of the techniques described in this disclosure will be apparent from the description, drawings, and claims.

DETAILED DESCRIPTION

Figure 1:
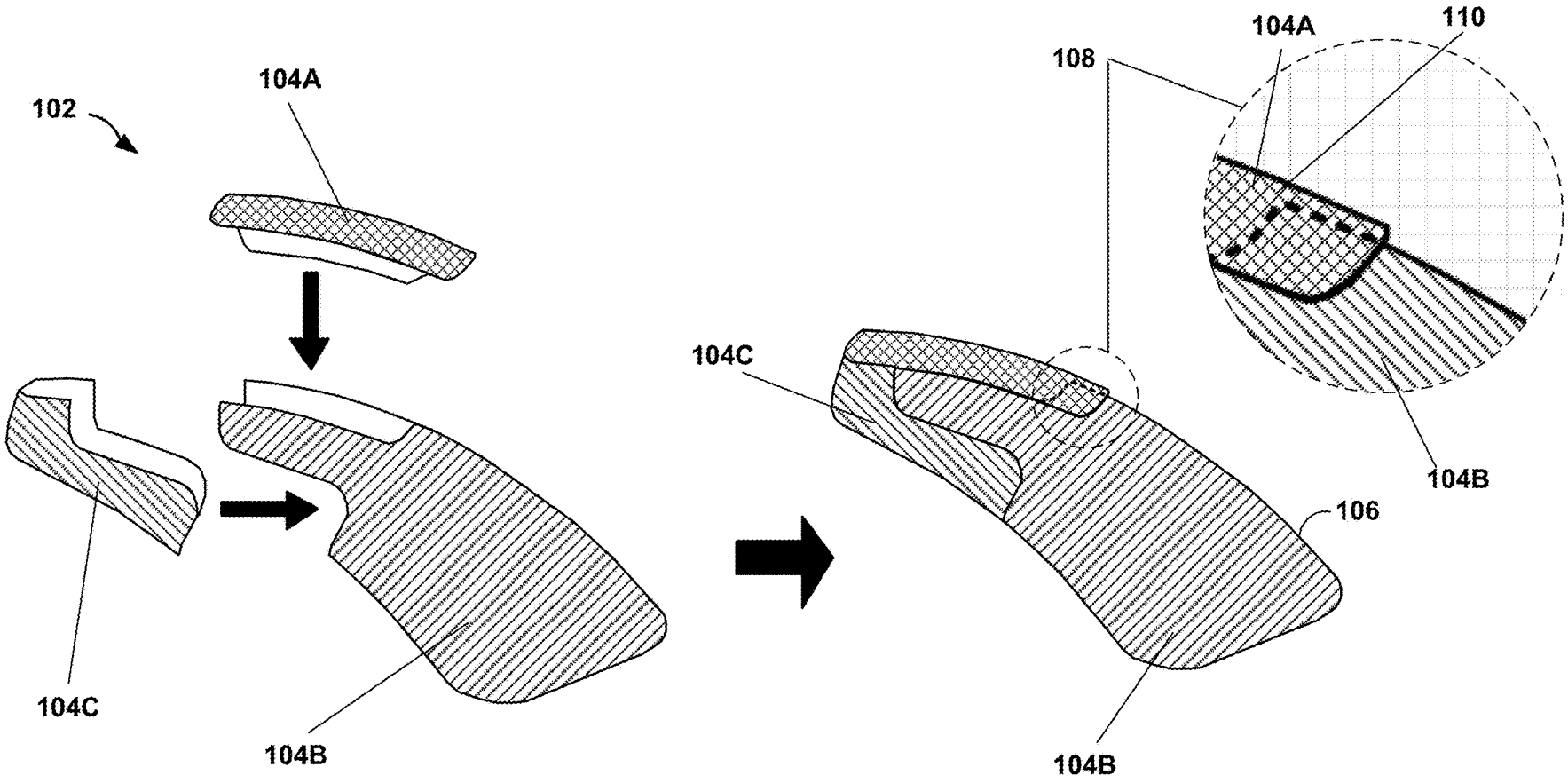
FIG. 1 is a conceptual diagram illustrating an example ear-wearable device, in accordance with one or more aspects of the present disclosure.

FIG. 1 is a conceptual diagram illustrating an example ear-wearable device, in accordance with one or more aspects of the present disclosure. Ear-wearable device (EWD) 102 of FIG. 1 is an example of an ear-wearable device that includes a plurality of modules 104A through 104C (collectively "modules 104") that mate together forming physical outer shell 106 of EWD 102. It should be understood that EWD 102 is only one example of an ear-wearable device according to the described techniques. EWD 102 may include additional or fewer components than those shown in FIG. 1.

EWD 102 is primarily configured to provide sound to a user for hearing. As the term is used herein, an ear-wearable device, such as a hearing assistance device, a hearing device, and a hearing instrument, refers to any ear-wearable device that is used as a hearing aid, a personal sound amplification product (PSAP), a headphone set, a hearable, a wired or wireless earbud, or other hearing instrument that provides sound to a user for hearing. A single EWD 102 may be worn by a user (e.g., with unilateral hearing loss). Two hearing instruments, such as EWD 102, may be worn by the user (e.g., with bilateral hearing loss) with one instrument in each ear. The described techniques are applicable to any hearing instruments that provide sound to a user for hearing.

In some examples, EWD 102 is a hearing assistance device. In general, there are three types of hearing assistance devices. A first type of hearing instrument includes a housing or shell that is designed to be worn in the ear for both aesthetic and functional reasons. The housing or shell encloses electronic components of the hearing instrument. Such devices may be referred to as in-the-ear (ITE), in-the-canal (ITC), completely-in-the-canal (CIC), or invisible-in-the-canal (IIC) hearing instruments. Some ITE, ITC, CIC, or IIC hearing instruments have limited capabilities due to their small size and limited volume for housing electronic components. Other drawbacks of ITE, ITC, CIC, or IIC devices include a shortened battery life, lower fit rates due to the volume of components to be placed in the canal, lack of wireless features like programming and audio streaming, a telecoil, and potential patient frustration with changing batteries.

A second type of hearing instrument, referred to as a behind-the-ear (BTE) hearing instrument, includes a housing worn behind the ear which contains all of the electronic components of the hearing instrument, including the receiver (i.e., the speaker). An audio tube conducts sound from the receiver into the user's ear canal.

A third type of hearing instrument, referred to as a receiver-in-canal (MC) hearing instrument, has a housing worn behind the ear that contains some electronic components and further has a housing worn in the ear canal that contains some other electronic components, for example, the receiver. The behind the ear housing of a MC hearing instrument is connected (e.g., via a tether or wireless link) to the housing with the receiver that is worn in the ear canal. EWD 102 may be an ITE, ITC, CIC, IIC, BTE, RIC, or other type of hearing instrument.

EWD 102 includes multiple modules 104. Each of modules 104 may be associated with a different, corresponding feature or characteristic of EWD 102, including mechanical and electrical characteristics. Each of modules 104 may provide EWD 102 with a unique feature or characteristic that may be different from features or characteristics provided by other of modules 104. In some cases, two or more modules 104 may be similar or the same. For example, two different microphones may be used by a single EWD 102; one type of microphone (e.g., omnidirectional) may be used by one of modules 104 and a different type of microphone (e.g., unidirectional) may be used by a different one or modules 104. Modules 104 may be classified according to feature type, and further subclassified according to a particular feature of that feature type.

Modules 104 may come in a variety of configurations and can be mixed and matched to create a unique design. For example, two different modules 104 may have different battery chemistries. Different modules 104 may come with or without user controls. Some modules 104 may support direct audio input whereas others may not. Some modules 104 may include antennas with some being omni antennas or directional antennas. Some modules 104 may include a telecoil and some of modules 104 do not include a telecoil. Some modules 104 may be adapted for wireless communication or charging and others may be configured to perform wired communication or wired charging. Some of modules 104 may include sensors and some may not. Similar-functioning modules 104 may come in a variety of colors, shapes, and sizes, so that EWD 102 may be customized for a particular user's taste or needs. For example, one user may prefer to have a multicolored EWD 102 made from a plurality of different colored modules 104 whereas a second user may prefer to have a more uniform colored EWD 102 made from a plurality of similarly colored modules 104.

Module 104A may be classified as an input module or a microphone module that provides audio input capability to EWD 102. However, in some examples, module 104A includes a single microphone and is subclassified as a single microphone module, whereas in other examples, module 104A may include multiple microphones (e.g., a directional microphone system) and therefore be classified as a microphone module with directional listening capability. EWD 102 may include either the single microphone version of module 104A or the multiple microphone version of module 104A depending on the particular application or use case for EWD 102.

Module 104B may be classified as a common electronics module that performs processing, communications, and power management operations associated with EWD 102. For example, module 104B may include a flexible printed circuit board, processor, memory, and other components that are configured to control operations of EWD 102. However, in some examples, module 104B may be subclassified as a high-performance common electronics module due to reliance on one or more very fast or more advanced processors, whereas in other examples, module 104B may be subclassified as a low performance common electronics module that relies on a single, less advanced, or slower processor. In a similar way that EWD 102 may include either the single microphone version of module 104A or the multiple microphone version of module 104A, depending on the particular application or use case for EWD 102, EWD 102 may include a more advanced or less advanced common electronics module 104B.

Module 104B may include a battery for powering electronic components of EWD 102 including those components found in other modules 104. The battery of module 104B may have a specific battery chemistry or module 104B may have other unique properties (e.g., access door, no access door, etc.) that make module 104B particularly useful for a particular embodiment of EWD 102. On the other hand, module 104B may include a different type of battery or may have other properties that make module 104B less suited for a particular application of EWD 102; EWD 102 may therefore use a different version of module 104B to power internal components.

Module 104C may be classified as an output module that outputs audible signals that can be sensed by a user, from an ear, and interpreted as sound. Module 104C may configure EWD 102 as either a behind-the-ear (BTE) hearing aid or a receiver-in-ear canal (MC) hearing aid. For example, Module 104C may be a BTE module with a receiver (i.e., speaker) that provides listening capability to EWD 102. Module 104C may be a MC module that does not include a receiver, but instead includes components to communicate (e.g., via telecoil or MC cable) to a corresponding in-ear unit of EWD 102 (not shown in FIG. 1).

Although shown as having three modules 104, EWD 102 in other examples may have more than three or less than three modules 104. By mixing and matching different modules 104, a user or manufacturer can tailor EWD 102 for a specific user or type of user.

Each of modules 104 shares a physical interface with at least one other module 104. That is, as shown in FIG. 1, module 104A fits together with module 104C and module 104B mates together with modules 104A and 104C. Outer shell 106 of EWD 102 is formed from a respective physical portion of each of modules 104 when modules 104 are mated together. Each of modules 104 includes a respective physical portion that comprises a different, corresponding part of outer shell 106. Modules 104 fit together to form outer shell 106 using various coupling features, such as slots, dovetails, cross pins, magnets, etc. The coupling features may be in any orientation relative to modules 104.

As shown in FIG. 1, the physical interface between at least two modules may include an air gap 108 formed in outer shell 106 or other type of sound inlet, e.g., for receiving sound. That is, rather than provide a uniform effect throughout outer shell 106, the outer surfaces of two or more modules 104 may produce a break in what would otherwise be a mostly smooth and seemingly, seamless outer shell 106. This, "sound inlet", including but not limited to air gap 108, may improve functionality and/or enhance ingress protection of at least one of the at least two modules 104. In other words, air gap 108 serves a functional purpose, for example, for capturing sound waves picked up by a microphone of modules 104 and/or for improving the IPxx rating of EWD 102 by providing egress protection for preventing moisture, debris, or other contaminants from reaching and damaging the microphone. For example, the outer surface of module 104A may fit together with module 104B by overlapping at least part of module 104B. Said differently, to form, in the physical interface between modules 104A and 104B, air gap 108, a respective physical portion of a module 104A may overlap some of a respective physical portion of module 104B.

While described as an air gap, air gap 108 may be a different type of inlet for receiving sound, including, but not limited to a mesh opening, sound slit, vent, or other opening in outer shell 106, e.g., for receiving sound. Throughout the disclosure the term "air gap" is used although other types of inlets for receiving sound may be used in accordance with the described techniques. In addition, modules 104 may include additional or fewer sound inlets than what is shown in the drawings. That is, while air gap 108 may be one type of sound inlet that could keep material out of an interior cavity of modules 104, e.g., a microphone module, additional or fewer sound inlets may be used. For example, modules 104 may include additional sound inlets on one or more sides of that module (e.g., top, sides, bottom).

By overlapping at least part of module 104B to form air gap 108, modules 104A and 104B may better prevent moisture and other debris from entering the physical interfaces and internal cavities of modules 104A or 104B.

As one example, module 104A may include a microphone that relies on air gap 108 and tunnel 110 within outer shell 106, for receiving sounds. In other words, air gap 108 forms at least part of an opening into tunnel 110 for propagating sound from outside outer shell 106 to inside outer shell 106 and to the microphone of module 104A. Said differently, at least two modules 104 form air gap 108 in outer shell 106 by forming tunnel 110, in the physical interface between the at least two modules 104A and 104B. Tunnel 110 carries air from outside outer shell 106 to the at least one microphone of the at least two modules 104A and 104B.

While simultaneously creating tunnel 110 channel that funnels sound waves from air gap 108 to the microphone, modules 104A and 104B may enhance the ingress protection to module 104A by protecting the microphone of module 104A from moisture and/or debris that may otherwise reach the microphone, from an outside environment. Modules 104A and 104B, in forming air gap 108, may further prevent wind and other noise from reaching the microphone of module 104A.

In some examples, even if debris or moisture were to enter air gap 108 and tunnel 110 and therefore reach the microphone of module 104A, the other modules 104 of EWD 102 are protected from the moisture or debris due to the modular design of EWD 102. Said differently, each of modules 104, through a respective housing or respective casing, may be configured to confine any debris or moisture that enters that module, from reaching any other one of modules 104, e.g., as a way to contain internal moisture and debris leaks. In this way, for example, if water were to damage a microphone of module 104A, the water will not enter module 104B or 104C because each of modules 104 may otherwise be closed or sealed-off. A user could replace a damaged module 104A with a new, undamaged module 104A, without having to replace any other components or modules 104 of EWD 102. This modular design may further increase the IPxx rating for egress protection associated with EWD 102, as the modular design further prevents against cross-module contamination from debris, moisture, and the like.

In some examples, not all modules 104 are sealed or closed-off and protected from outside moisture and debris. For example, a main electronics module of EWD 102, such as module 104B, may be sealed and protected from outside environments; whereas other modules 104, such as modules 104A and 104C may not be sealed or as-protected. In this way, a manufacturer can mix and match sealed and unsealed modules 104 depending on an application or use-case for EWD 102. The manufacturer may offer a more expensive version of EWD 102 where each module 104 is sealed from outside moisture and debris. In addition to the more expensive version, a manufacturer may offer a less expensive version of EWD 102 where, for example, only module 104B (e.g., including a processor) is sealed and unsealed modules 104A and 104C are used for input and output functions. In some examples, unsealed modules 104 may attach to, and form physical interfaces with, a sealed module 104.

FIGS. 2A through 2E are conceptual diagrams illustrating ways to combine modules into example hearing assistance devices (HADs), in accordance with one or more aspects of the present disclosure. Modules 204A through 204D of FIGS. 2A through 2E (collectively "modules 204") are examples of modules 104 of FIG. 1 and HAD 202 is an example of EWD 102 of FIG. 1. It should be understood that HAD 202 is only one example of a hearing assistance device according to the described techniques. HAD 202 may include additional or fewer components than those shown in FIGS. 2A through 2E. FIGS. 2A through 2E demonstrate how a single EWD that is reconfigurable as a BTE type HAD with a receiver worn behind the hear or a RIC type HAD with the receiver worn inside an ear canal.

Figure 2B:
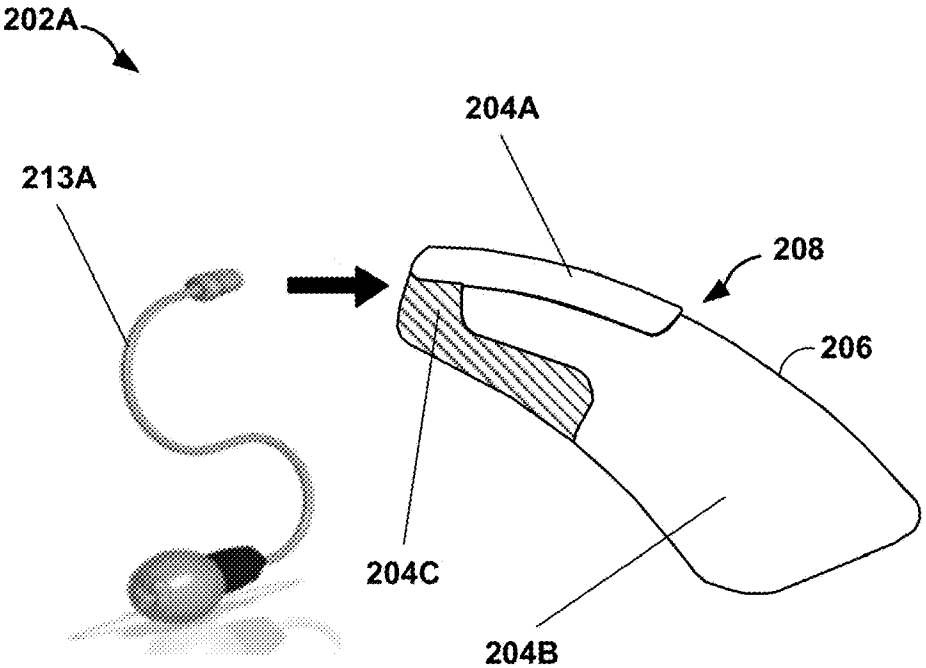
FIGS. 2A through 2E are conceptual diagrams illustrating ways to combine modules into example ear-wearable devices, in accordance with one or more aspects of the present disclosure.
Figure 2A:
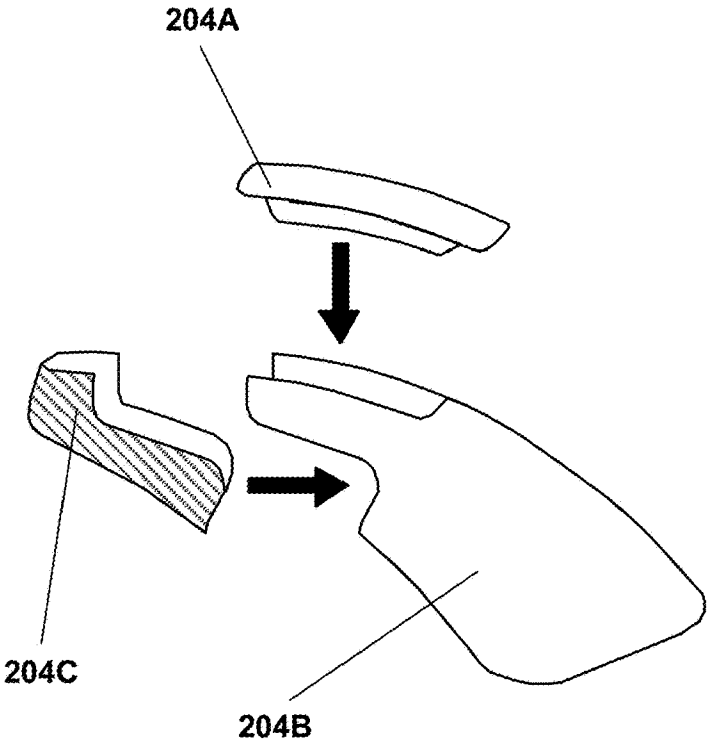

FIG. 2A includes modules 204A through 204C shown fitted together to create HAD 202A as an example MC type HAD with a receiver worn inside an ear-canal. For example, a BTE portion of HAD 202A may include: module 204A as a replaceable microphone module, module 204B as a common electronics module (e.g., sound processor), and module 204C which is configured to couple module 204A and 204B to in-ear component 213A. In-ear component 213A includes an in-ear portion with a receiver (e.g., speaker) designed to fit in a person's ear canal and a tethering portion that is configured to carry audio signals from the BTE portion of HAD 202A to the receiver in the user's ear.

HAD 202A includes outer shell 206 formed from at least part of each of modules 204A through 204C. Outer shell 206 includes air gap 208 formed in a physical interface between modules 204A and 204B by the exterior shape of modules 204A and 204C. Air gap 208 may receive sound for a microphone or other components of module 204A.

Figure 2D:
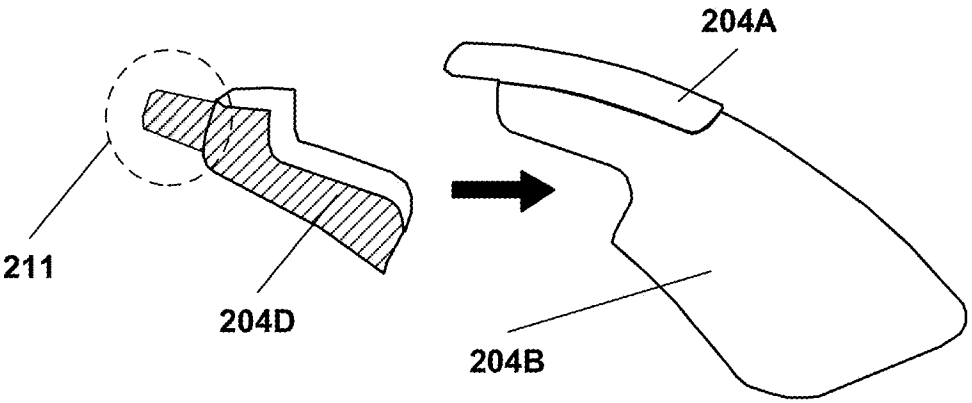
Figure 2C:
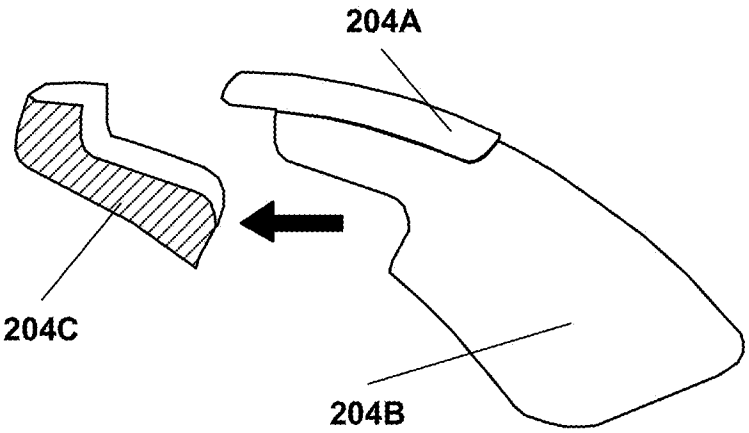
Figure 2E:
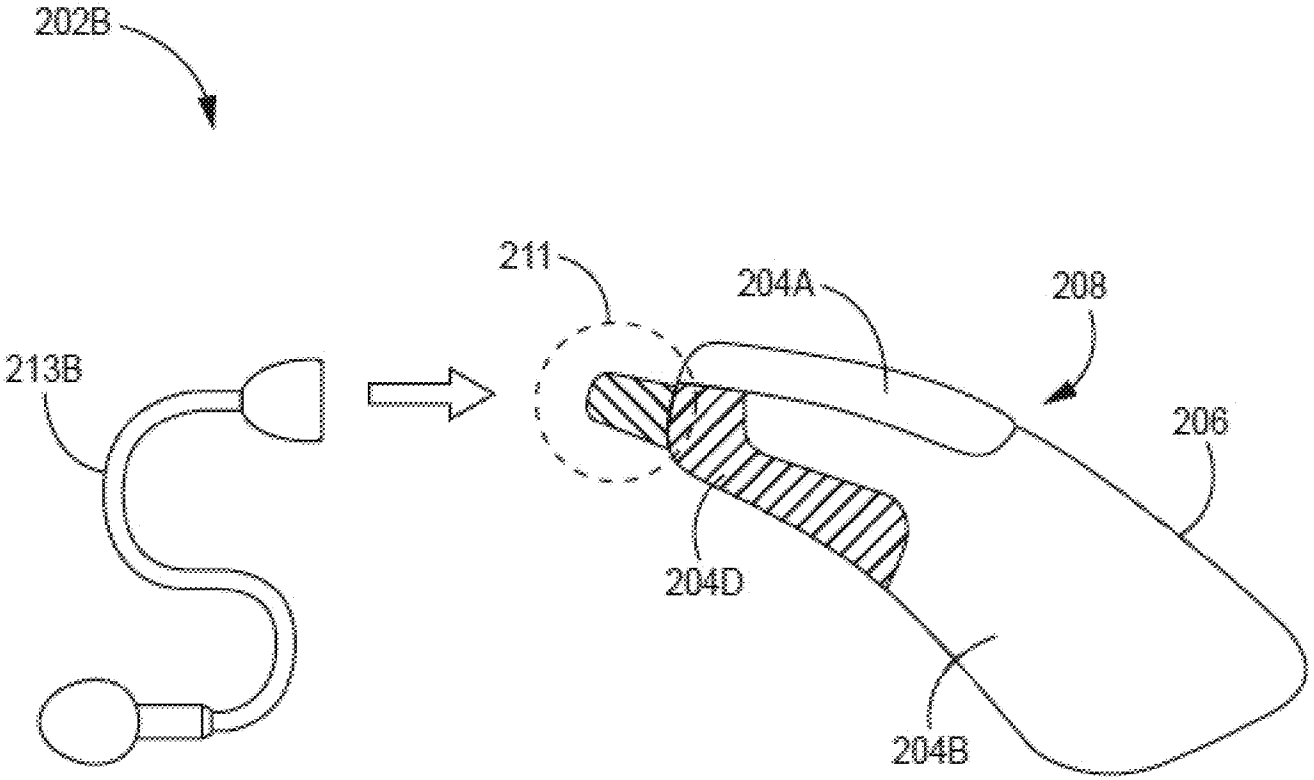

A user or manufacturer may reconfigure HAD 202A into a different type of hearing assistance device. For example, the hearing assistance device may be reconfigured from being HAD 202A, i.e., a RIC type hearing device, to being HAD 202B, i.e., a BTE type hearing device with a receiver behind the ear as opposed to in the ear. HAD 202A may be reconfigured into HAD 202B by exchanging module 204C with a different module 204D that includes a receiver and connection point 211 configured to couple module 204D to an in-ear component 213B. As shown in FIG. 2C, the user or manufacturer may remove module 204C from HAD 202A and, as shown in FIG. 2D, the user or manufacturer may fit module 204D together with modules 204A and 204B. The user or manufacturer may attach in-ear component 213B (which is a tube configured to carry sound being output by modules 204D) to connection point 211, to create HAD 202B, as show in FIG. 2E.

In-ear component 213B may be a sound tube that attaches directly to connection point 211. In other examples, connection point 211 is configured to attach to a "sound hook" of in-ear component 213B (e.g., a plastic cone shaped piece that loops over the top of a user's ear to keep HAD 202B place). The sound hook of in-ear component 213B, if used, may attach directly to the sound tube portion of in-ear component 213B.

In this way, potentially without any reprogramming or other modifications to HAD 202A and 202B, a user, retailer, or device manufacturer can reuse similar modules 204 across a range of hearing devices 202A and 202B to customize devices 202A and 202B by swapping out individual modules 204 for other modules 204 that are better suited for a particular user or use case. Reconfiguration can be performed by a user, retailer, manufacturer, or other entity. Such reconfiguration may be performed in a distribution center, retailer facility, office, at home, or at another location. Should modules 204 fail or need to be replaced, the user, retailer, manufacturer, or other entity may be able to easily replace modules 204. Being able to easily exchange modules 204 may provide flexibility for supply chain management, as individual modules 204 can be built in different production facilities or outsourced to be assembled at or near a location associated with a point of sale.

Figure 3:
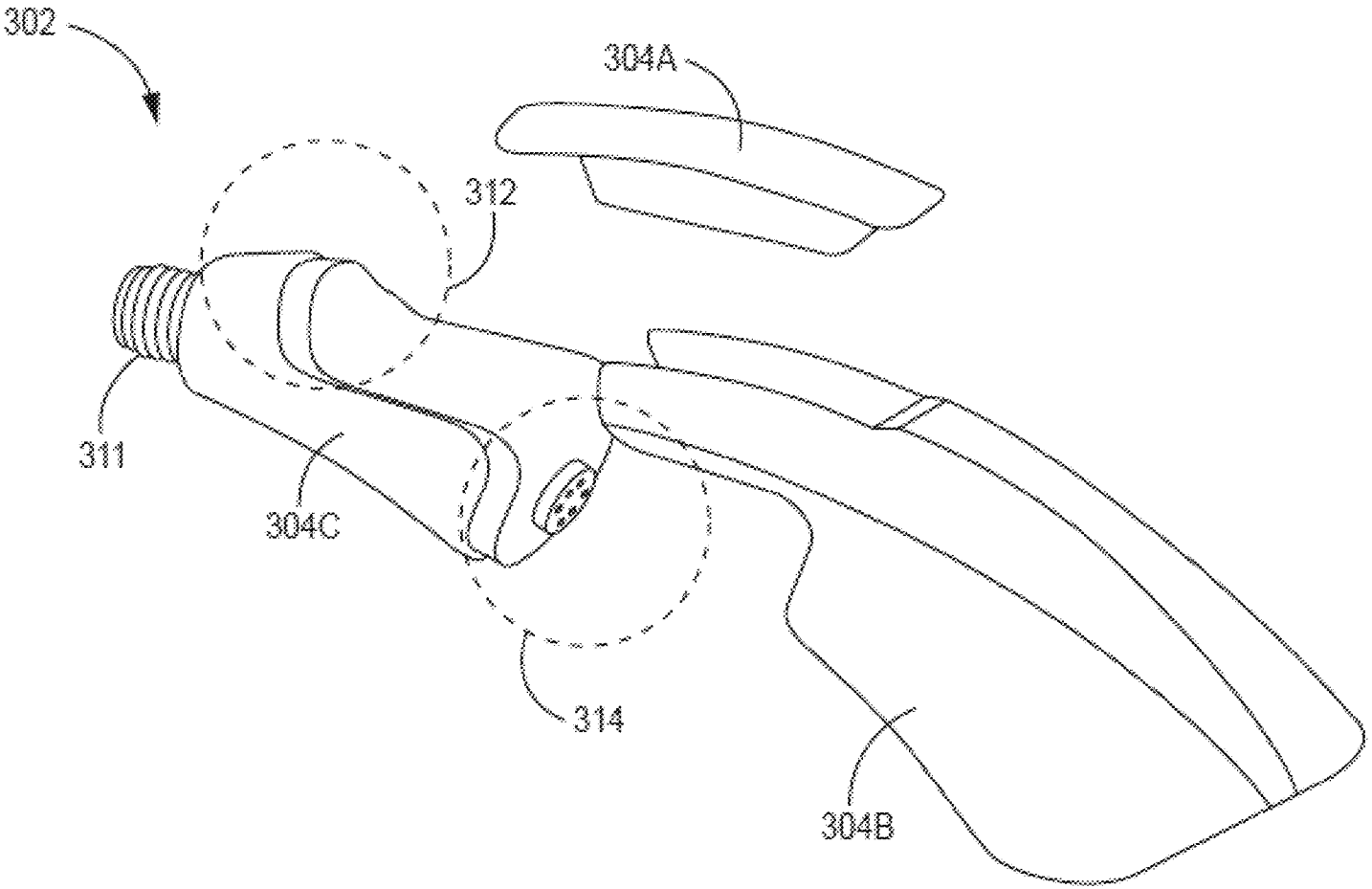
FIG. 3 is a conceptual diagram illustrating further details of an example ear-wearable device, in accordance with one or more aspects of the present disclosure.

FIG. 3 is a conceptual diagram illustrating further details of an example ear-wearable device, in accordance with one or more aspects of the present disclosure. EWD 302 is an example of EWD 102 and HADs 202 of FIGS. 1 and 2A through 2E. EWD 302 is only one example of an ear-wearable device according to the described techniques. EWD 302 may include additional or fewer components than those shown in FIG. 3.

EWD 302 is formed by combining modules 304A through 304C (collectively "modules 304"). Each module 304 shares a physical interface with at least one other module 304 and in some examples, modules 304 may share an electrical interface with one other module 304.

For instance, as shown in FIG. 3, modules 304C and 304B share a physical interface 312. Physical interface 312 may include slots, grooves, magnets, dovetails, or other retention features or coupling features that tightly couple module 304C to module 304B, for instance, to create a seal that prevents dust, water, air, and/or other debris from entering modules 304 via physical interface 312. In some cases, physical interface 312 may rely on glue, sealant, screws, cross pins and/or other fasteners or coupling features to create a tight physical seal between modules 304B and 304C.

As further shown in FIG. 3, modules 304C and 304B share an electrical interface 314. Electrical interface 314 may include various types connectors, pins, or other electrical and electro-mechanical features that electrically couple module 304C to module 304B, for instance, for exchanging electrical signals or information between modules 304B and 304C. For example, a receiver of module 304C may receive electrical audio signals from a sound processor of module 304B and convert the electrical audio signals to sound waves that module 304C outputs to a sound tube coupled to connection point 311.

Figure 4:
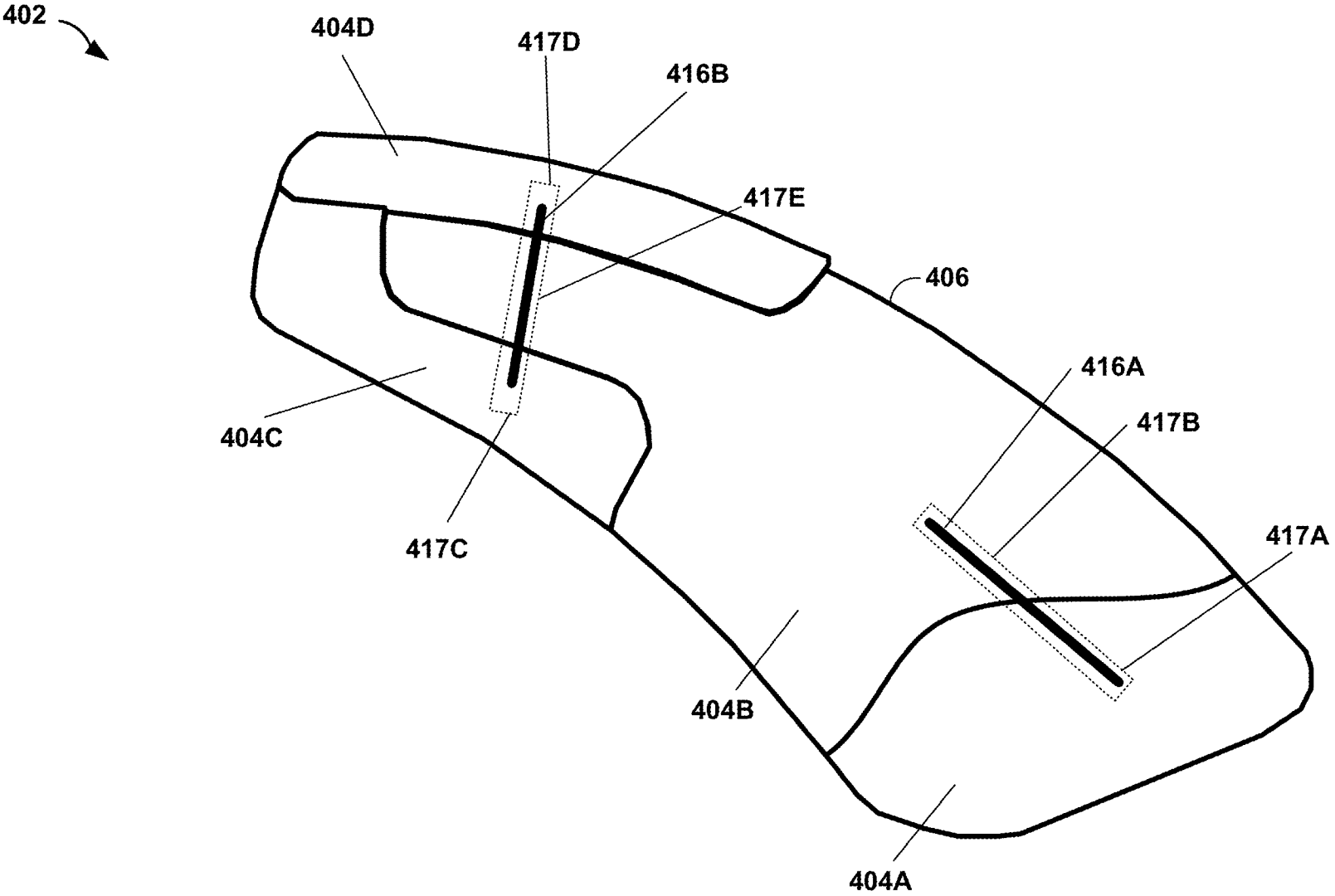
FIG. 4 is a conceptual diagram illustrating coupling features of an example ear-wearable device, in accordance with one or more aspects of the present disclosure.

FIG. 4 is a conceptual diagram illustrating coupling features of an example ear-wearable device, in accordance with one or more aspects of the present disclosure. That is, FIG. 4 shows a side-cross sectional view of an example EWD, to further illustrate various coupling feature of the EWD, in accordance with one or more aspects of the present disclosure.

EWD 402 is an example of EWD 102, HAD 202, and EWD 302 of FIGS. 1, 2A through 2E, and 3. EWD 402 is only one example of an ear-wearable device according to the described techniques. EWD 402 may include additional or fewer components than those shown in FIG. 4.

EWD 402 includes modules 404A through 404D (collectively "modules 404") mated together to form outer shell 406. Each of modules 404 is shown being physically coupled, attached, or mated to at least one other module 404 via one or more coupling features 416A and 416B (collectively "coupling features 416"). In some examples, coupling features 416 are cross pins, screws, or other attachment features that secure two modules 404 together. For example, coupling feature 416A may be a screw or cross pin that physically secures part of module 404B to part of module 404A. Each of coupling features 416 may secure two modules 104, or more than two modules 104. For example, while coupling feature 416A may force two modules 404A and 404B together at a physical interface between modules 404A and 404B, coupling feature 416B is shown in FIG. 4 securing three modules 404B, 404C, and 404D together at a physical interface between modules 404B and 404C and a second physical interface between modules 404C and 404D. HAD 402 may utilize coupling features such as coupling features 416 in addition to, or as an alternative to other types of coupling features, such as dowels, rods, slots, grooves, magnets, dovetails, or other retention features, as described with reference to HAD 302 of FIG. 3.

Modules 404 may include one or more holes or cavities in the respective physical outer surface of each of modules 404, for example, to receive one of coupling features 416. For example, module 404B may include cavity 417B configured to receive a first portion of coupling feature 416A and module 404A may include cavity 417C that configures module 404A to receive a remaining portion of coupling feature 416A.

Module 404B may further include cavity 417E. Cavity 417E is a tunnel configured to receive a middle portion of coupling feature 416B. Module 404D may include cavity 417D that configures module 404D to receive a first distal portion of coupling feature 416B. Module 404C may include cavity 417C that configures module 404C to receive a second distal portion of coupling feature 416B. In this way, cavities 417C, 417D, and 417E configure modules 404B, 404C, and 404D to receive a respective portion of coupling feature 416B thereby joining modules 404B, 404C, and 404D, together.

Figure 5:
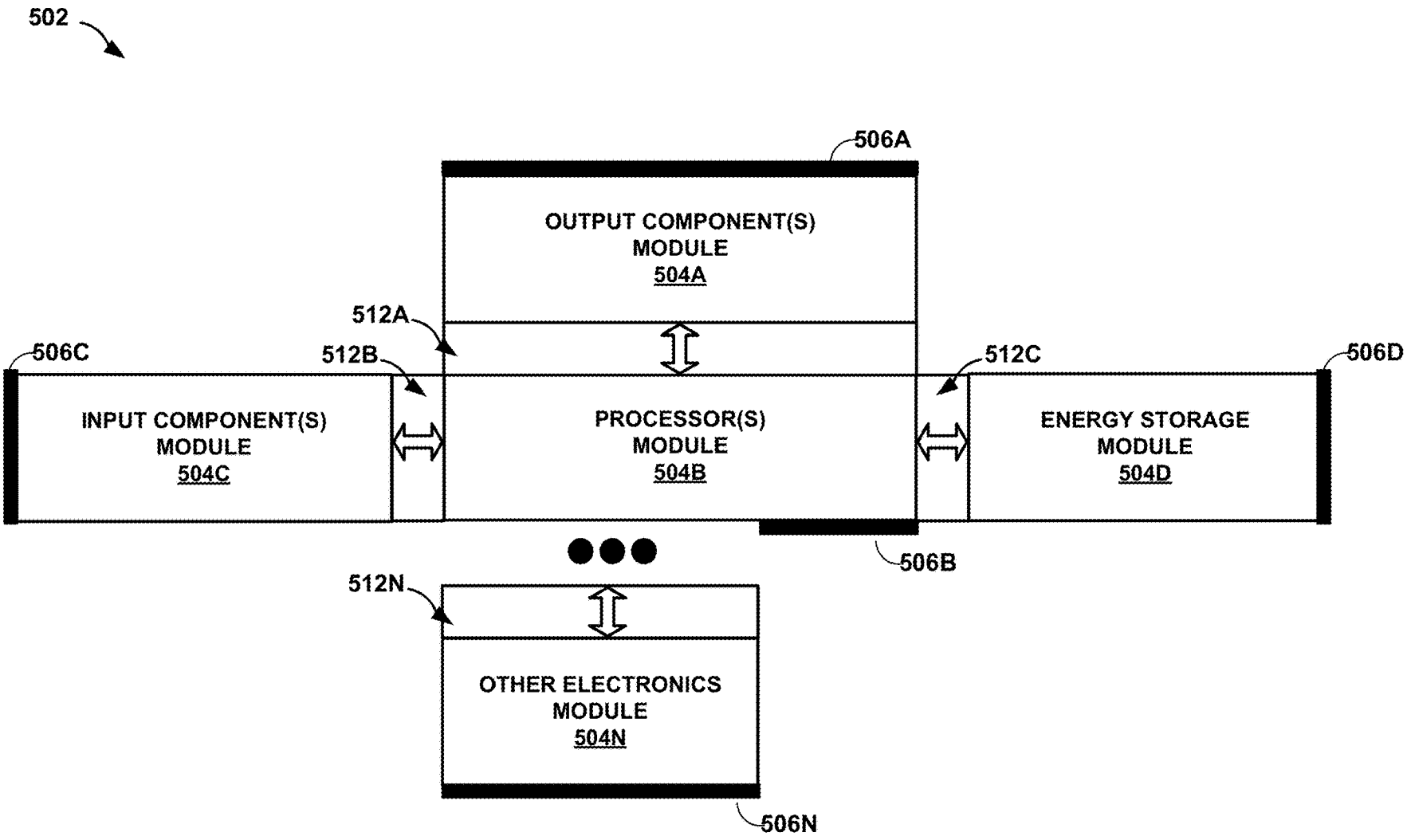
FIG. 5 is a block diagram illustrating components of an example ear-wearable device, in accordance with one or more aspects of the present disclosure.

FIG. 5 is a block diagram illustrating components of an example ear-wearable device, in accordance with one or more aspects of the present disclosure. EWD 502 is only one example of an ear-wearable device according to the described techniques. EWD 502 may include additional or fewer components than those shown in FIG. 5.

EWD 502 includes modules 504A through 504N, collectively "modules 504." Modules 504A and 504B share physical interface 512A. Modules 504B and 504C share physical interface 512B. Modules 504B and 504D share physical interface 512C. Modules 504B and 504N may share physical interface 512N or EWD 502 may include additional modules (not shown) that share a physical interface with modules 504B or 504N.

Each of module 504 includes a respective physical portion 506A through 506N that forms part of an outer shell of EWD 502. For instance, EWD 502 may include an outer shell made up of at least, physical portions 506A, 506B, 506C, 506D, and 506N.

Each of modules 504 serves a specific functional purpose of EWD 502. That is, each of modules 504 provides a unique capability to EWD 502. In some examples, two or more modules 504 may be similar, the same, or overlap in some capability. For example, EWD 502 may include multiple modules 504C, with each of modules 504C having a different type of microphone (e.g., so as to configure EWD 502 for having one or more of unidirectional, multidirectional, and/or omnidirectional microphone capabilities.)

Module 504A may house output components of HAD 502. Examples of output components include any electrical component configured to generate various types of output, including tactile output, audible output, visual output, and other forms of output. Non-limiting examples of output components within module 504A may include a sound card, a video card, a speaker, a vibration device, a light, a light emitting diode (LED), or any other type of device for generating output to a human or machine.

Module 504C may house input components of HAD 502. Examples of input components include any electrical component configured to receive various types of input, including tactile input, audible input, image or video input, sensory input, and other forms of input. Non-limiting examples of input components of module 504C include a direct audio input (DAI), a button, a switch, a key, a microphone, a camera, or any other type of device for detecting input from a human or machine. Other non-limiting examples of input components include one or more sensor components, such as a proximity sensor, a global positioning system (GPS) receiver or other type of location sensor, an accelerometer, an inertial measurement unit (IMU), a temperature sensor, a barometer, a gyro, an ambient light sensor, a proximity sensor, a hydrometer sensor, a heart rate sensor, a magnetometer, a glucose sensor, an olfactory sensor, a compass, a step counter, to name a few other non-limiting examples.

In some examples, the input components of module 504C may include a telecoil. As a telecoil, the input components of module 504C may enable HAD 502 to communicate with an external device. For example, module 504C may rely on a microphone to pick up audible sounds in the environment; processors of module 504B and output components of module 504C may convert the microphone inputs captured by input components of module 504C into sound for hearing. However, in some cases, a user of HAD 502 may use an external device, such as a mobile phone or a vehicle infotainment system, e.g., to listen to music, to make a telephone call, etc. Rather than relying on a microphone as one of input components of module 504C to pick up audio being output by a speaker the external device, HAD 502 may switch to using a telecoil of input components of module 504C to receive, directly from the mobile phone, audio signals that processors of module 504B and output components of module 504A may convert into sound. Having a telecoil as one of input components of module 504C, HAD 502 may output better quality (e.g., cleaner) sound as the original audio signal is received directly from an external device, and therefore, less likely to include noise and other distortions that are sometimes present in sound being output by HAD 502, particularly, when the original audio signal is captured by a microphone. A feature, like a telecoil, may not be a necessary feature for some users of HAD 502. As such, module 504C may come in multiple configurations.

In some configurations, module 504C may include microphone and telecoil type input components. In other configurations, e.g., cheaper or less complex configurations, module 504C may only include a microphone, telecoil, or other type of input component. By offering different configurations of module 504C, HAD 502 may appeal to users and consumers that are at different price points. Offering different configurations may further enable HAD 502 to be marketed in different jurisdictions, e.g., in one region where telecoils are approved for use in ear-wearable devices, a version of module 504C with and without telecoil may be sold whereas in a different region where telecoils are not permitted for use in ear-wearable devices, only a version of module 504C without telecoil may be sold. In some examples, for instance if HAD 502 is a RIC device, in lieu of or in addition to a cable or tether communicatively coupling a BTE portion of the RIC device to the in-ear portion of the RIC device, a telecoil of input components 504C may be used to enable communication between the BTE and in-ear portions.

Module 504B may house processors and/or data storage (e.g., memory) used by HAD 502 to execute operations that implement functionality of HAD 502. Examples of processors included in module 504B are fixed-function processing circuits, programmable processing circuits, or a combination of fixed-function and programmable processing circuits. Further examples of processors include digital signal processors, general purpose processors, application processors, embedded processors, graphic processing units (GPUs), digital signal processors (DSPs), application specific integrated circuits (ASICs), field programmable gate arrays (FPGAs), display controllers, auxiliary processors, sensor hubs, input controllers, output controllers, microcontrollers, and any other equivalent integrated or discrete hardware or circuitry configure to function as a hardware processor, a processing unit, or a processing device. Module 504B may further include memory or other data storage including instructions that, when executed by the processors of module 504B, cause HAD 502 to perform a function. In other examples, the memory or data storage of HAD 502 may be located in a different module than module 504B.

When module 504B includes data storage, the data storage may be fixed and/or removable data storage units configured to store information for subsequent processing by processors of module 504B. In other words, the data storage of module 504B may retain data accessed by the processors of module 504B, and/or other modules 504 of HAD 502.

Data storage, in some examples, includes a non-transitory computer-readable storage medium that stores instructions, program information, or other data accessed by processors of module 504B. That is, the processors of module 504B may retrieve instructions stored by a data storage device of module 504B and execute the instructions to perform operations described herein.

The data storage of module 504B may include a combination of one or more types of volatile or non-volatile memories. In some cases, the data storage includes a temporary or volatile memory (e.g., random access memories (RAM), dynamic random-access memories (DRAM), static random-access memories (SRAM), and other forms of volatile memories known in the art). In such a case, the data storage is not used for long-term data storage and as such, any data stored by the storage device is not retained when power to the data storage device is lost. The data storage device in some cases is configured for long-term storage of information and includes non-volatile memory space that retains information even after the data storage device loses power. Examples of non-volatile memories include magnetic hard discs, optical discs, flash memories, USB disks, or forms of electrically programmable memories (EPROM) or electrically erasable and programmable (EEPROM) memories.

Module 504D may house energy storage components of HAD 502. For example, module 504D may include a battery (e.g., disposable or rechargeable), a capacitor, or other type of electrical energy storage device that is configured to power each of the components of HAD 502 including one or more module 504. Although shown as only sharing physical interface 512C with module 504B, in other examples, module 504D shares a physical interface 512C with other modules 504. In this way, module 504D may power modules 504 directly by transmitting electrical power via interface 512C directly to a receiving module 504. In other examples, module 504D may power modules 504 indirectly by transmitting electrical power via interface 512C directly to module 504B, from which, the electrical power is transmitted via any of interfaces 512A, 512B, or 512N (e.g., to other modules 504).

Module 504D may include charging circuitry which is responsible for performing power management and charging of energy storage. The system charger may be a buck converter, boost converter, flyback converter, or any other type of AC/DC or DC/DC power conversion circuitry adapted to convert grid power to a form of electrical power suitable for charging energy storage. In some examples, the system charger includes a charging antenna (e.g., NFMI, RF, or other type of charging antenna) for wirelessly recharging energy storage. The system charger may rely on a wired connection to a power source for charging energy storage.

Module 504N may include any other component, electronic or not, used by HAD 502 to provide sound to a user for hearing. Examples of other components include communication units that enable communication with external devices (e.g., a computing device, a programmer, or other hearing device) through reception and transmission of signals being sent and received by HAD 502 (e.g., being broadcast through the air).

Communication units included in module 504B may include antennas, transmitters, and receivers. Examples of communication units include Bluetooth radios, short wave radios, cellular data radios, wireless network radios, universal serial bus (USB) controllers, proprietary bus controllers, network interface cards, optical transceivers, radio frequency transceivers, or any other type of device that can send and/or receive information through the air. In cases where communication units include a wireless transceiver, the communication units may be capable of operating in different radio frequency (RF) bands. A user or other entity may mix and match different modules 504N, according to the RF band associated with an internal radio (e.g., to enable regulatory compliance with a geographic location at which HAD 502 is being used). For example, a wireless transceiver of communication units 338 may operate in the 900 MHz or 2.4 GHz RF bands. A wireless transceiver of communication units 338 may be a near-field magnetic induction (NFMI) transceiver, and RF transceiver, an Infrared transceiver, ultra-sonic transceiver, or other type of transceiver.

In some examples, communication units in module 504N are configured as wireless gateways that manage information exchanged between HAD 502 and other devices. As a gateway, the communication units may implement one or more standards-based network communication protocols, such as Bluetooth®, Wi-Fi®, GSM, LTE, WiMax®, 802.1X, Zigbee®, LoRa® and the like as well as non-standards-based wireless protocols (e.g., proprietary communication protocols). The communication units may allow HAD 502 to communicate using a preferred communication protocol implementing on-body communication and convert the on-body communications to a standards-based protocol for sharing the information with other computing devices.

Figure 6A:
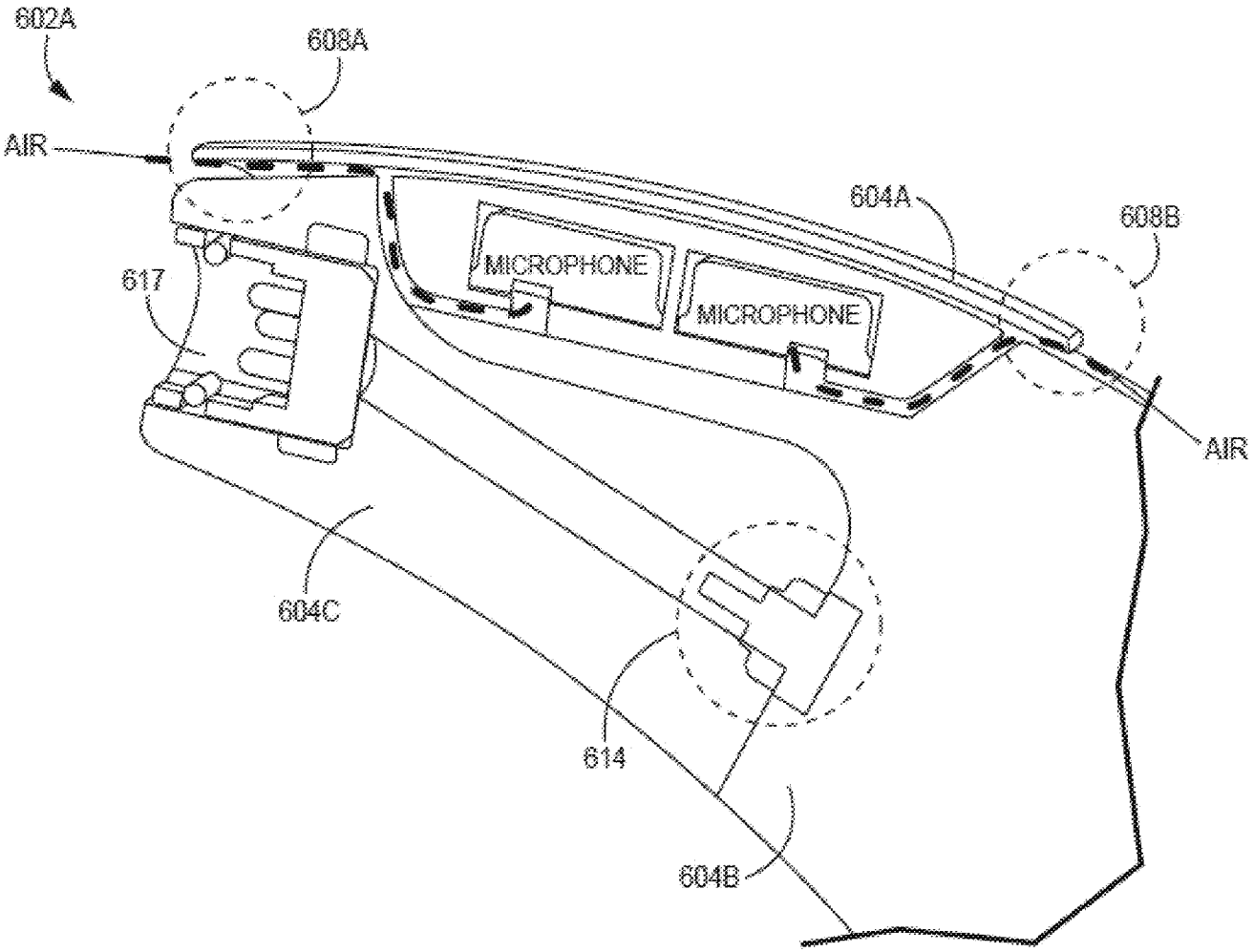
FIGS. 6A and 6B are conceptual diagrams illustrating further details of an example ear-wearable device, in accordance with one or more aspects of the present disclosure.
Figure 6B:
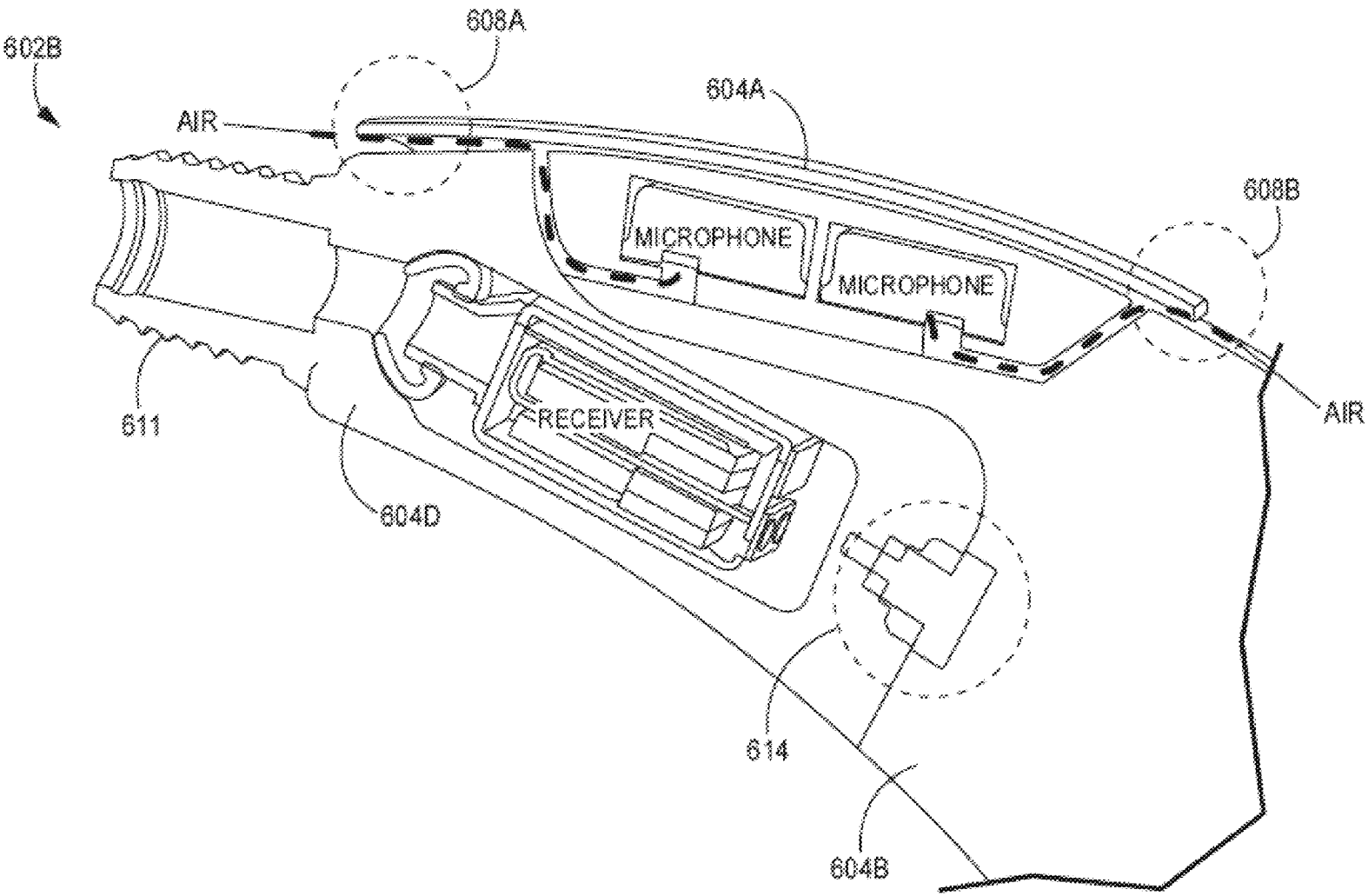

FIGS. 6A and 6B are conceptual diagrams illustrating further details of an example ear-wearable device, in accordance with one or more aspects of the present disclosure. FIGS. 6A and 6B show cross-sectional views of HAD 602A and HAD 602B, respectively. HAD 602A represents a RIC type ear-wearable device (e.g., with or without a telecoil) and HAD 602B represents a BTE type ear-wearable device (e.g., with a receiver BTE).

Each of HAD 602A and 602B includes identical modules 604A and 604B but differ in that HAD 602A includes a RIC type module 604C with an electrical connector 617 for coupling to an in-ear component with a receiver, whereas HAD 602B includes a BTE type module 604D with an internal receiver and connection point 611.

Each of HAD 602A and 602B includes multiple air gaps 608A and 608B. Air gaps 608A and 608B configure the outer shells of HAD 602A and 602B to receive air that carries sound waves received by the microphones of module 604A. That is, air gaps 608A and 608B produce an opening in the outer shell of HAD 608A and 608B that may funnel air carrying sound waves, through a tunnel within HAD 608A and 608B, to reach the microphones of module 604A. Air gap 608A may funnel first sound to a first microphone of module 604A and air gap 608B may funnel second sound to a second microphone of module 604A. In some cases, the two microphones are different microphones and in some examples, the microphones are configured to function like a single microphone pulling sound in from different directions.

As shown in FIGS. 6A and 6B, air gaps 608A and 608B may be formed by a portion of one of modules 604 overlapping with another one of modules 604 to form a protective tunnel through the outer shells and into microphone cavities of module 604A, thereby providing ingress protection to the microphones of modules 604A from wind, moisture, noise, or debris.

As further shown in FIGS. 6A and 6B, modules 604B may share an electrical interface 614 with modules 604C or 604D. Electrical interface 614 may include various types connectors, pins, contacts, or other electrical and electromechanical features that electrically couple module 604B to either of modules 604C or 604D. For example, in the case of HAD 602A an in-ear portion of HAD 602A that includes a receiver may plug into electrical connector 617 of module 604C to transmit any electrical signals received from the receiver to a sound processor in module 604B.

Figure 7:
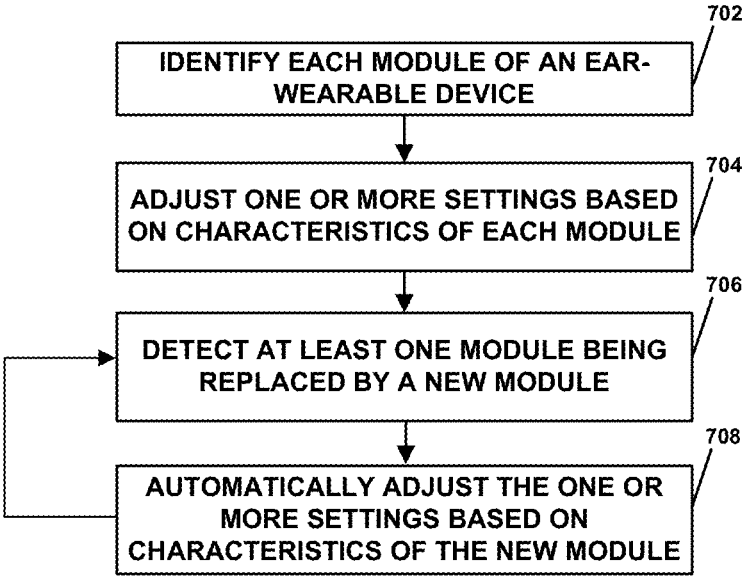
FIG. 7 is a flow chart illustrating example operations performed by an example ear-wearable device, in accordance with one or more aspects of the present disclosure.

FIG. 7 is a flow chart illustrating example operations performed by an example ear-wearable device, in accordance with one or more aspects of the present disclosure. FIG. 7 is described below in the context of HAD 502 of FIG. 5. HAD 502 may execute operations 702-708 in a different order than that shown in FIG. 7. HAD 502 may perform additional or fewer operations than those shown in FIG. 7.

In operation, HAD 502 may identify each module included in HAD 502 (702). For example, a processor of module 504B may determine which transducers or modules 504 share an electrical interface with module 504B or any other modules 504. The processor may determine the presence of each of modules 504 based on electrical signals received via interfaces either directly from one of modules 504, or indirectly, e.g., based on signal being passed through one of modules 504. For example, the processor of module 504B may determine that module 504C is part of HAD 502 based on an electrical connection (e.g., wired or wireless) established via interface 512B or based on an electrical connection that module 504C established via a different interface 512.

HAD 502 may adjust one or more one or more settings of the ear-wearable device based on characteristics of the other modules (704). For example, the processor of module 504B may determine that module 504A is a behind-the-ear input module and in response configure HAD 502 to perform operations associated with a behind-the-ear ear-wearable device. Whereas, the processor of module 504B may in other examples, determine that module 504A is a receiver-in-canal input module and in response configure HAD 502 to perform operations associated with a receiver-in-canal ear-wearable device.

The processor of module 504B may adjust a setting of HAD 502 so that the processor automatically executes different software or uses different circuits contained in any of modules 504, depending on whether HAD 502 includes as module 504A, a behind-the-ear module or a receiver-in-canal module. For instance, in response to determining that HAD 502 is in a BTE or RIC configuration, HAD 502 may execute software or instructions specific to either BTE or MC configurations.

In some examples, modules 504 may be marked on their outside surfaces with scan codes (e.g., a barcode, etc.). A manufacturer, assembler, or seller may scan each module 504 so that a programmer, manufacturing or fitting software, may automatically identify which modules 504 are included and in response, build a software configuration for the particular grouping of modules 504.

HAD 502 may detect at least one module being replaced with a new module (706). For example, in a similar way that the processor of module 504B identifies each module 504, the processor may automatically detect when a new module 504 is added to replace an existing module 504. That is, the processor may determine based on electrical signals obtained over interfaces 512 new information indicating one module 504 is no longer present and instead a different module 504 makes up HAD 502. For example, the processor of module 504B may determine that module 504A is now a receiver-in-canal module instead of a behind-the-ear module and in response reconfigure HAD 502 to perform operations associated with a receiver-in-canal ear-wearable device.

HAD 502 may automatically adjust the one or more settings of the ear-wearable device based on characteristics of the new module (708). For example, the processor of module 504B may adjust a setting of HAD 502 so that the processor automatically executes software for performing receiver-in-canal functions as opposed to functions performed when configured as a behind-the-ear ear-wearable device.

The modular design of EWD 102 may compartmentalize tolerance zones and acoustic effects to each individual module 104. This may lessen overall impact of slit leaks—i.e., electrical and acoustical noise leaking from one module 104 to another module 104—modules 104 allow for easier modeling of potential slit leaks because a substantial number of variables that module specific, can be eliminated from consideration when a particular module is being designed. Said differently, compartmentalization may eliminate slit leaks from EWD 102 when various components are compartmentalized into modules 104. As such, new modules, for instance new transducer modules can be quickly designed to test new receiver or microphone technologies. Therefore, the modular design of EWD 102 may enable further innovation to test and develop new modules without having to test or develop a completely new EWD.

Example 1. An ear-wearable device comprising: a plurality of modules that mate together forming a physical outer shell of the ear-wearable device, wherein: each module from the plurality of modules is associated with a different, corresponding feature of the ear-wearable device; each module from the plurality of modules includes a respective physical portion that comprises a different, corresponding part of the outer shell; and each module from the plurality of modules shares a physical interface with at least one other module from the plurality of modules.

Example 2. The ear-wearable device of example 1, wherein the first module or the second module comprise at least one microphone.

Example 3. The ear-wearable device of example 2, wherein at least two modules from the plurality of modules form, in the physical interface between the at least two modules, an air gap in the outer shell for receiving sound, and the respective physical portion of a first module from the at least two modules overlaps some of the respective physical portion of a second module from the at least two modules.

Example 4. The ear-wearable device of example 3, wherein the at least two modules form the air gap in the outer shell by forming a tunnel, in the physical interface between the at least two modules, that carries air from outside the outer shell to the at least one microphone of the first module or the second module.

Example 5. The ear-wearable device of any of examples 1-4, wherein the air gap is a first air gap in the outer shell for receiving first sound, and wherein the at least two modules from the plurality of modules further form, in the physical interface between the at least two modules, a second air gap in the outer shell for receiving second sound.

Example 6. The ear-wearable device of any of examples 1-5, wherein a particular module from the plurality of modules comprises a behind-the-ear transducer including a receiver and a connection point configured to couple the particular module to an in-ear component of the ear-wearable device.

Example 7. The hearing device of any of examples 1-6, wherein a particular module from the plurality of modules is configured to communicate with an in-the-ear transducer of the ear-wearable hearing device.

Example 8. The hearing device of any of examples 1-7, wherein a particular module from the plurality of modules comprises a processor.

Example 9. The hearing device of example 8, wherein the processor is configured to detect when an existing module from the plurality of modules is replaced with a new module.

Example 10. The hearing device of example 9, wherein the processor is configured to automatically reconfigure the hearing device to enable the new module in response to detecting when the existing module from the plurality of modules is replaced with the new module.

Example 11. The hearing device of any of examples 1-10, wherein at least two of the plurality of modules mate together via an electrical interface.

Example 12. The hearing device of example 11, wherein the electrical interface comprises one or more pins, magnets, or contacts.

Example 13. The hearing device of any of examples 1-12, wherein at least two of the plurality of modules mate together via one or more reciprocal slots, dovetails, or cross pins for form-fitting together the respective physical portion of each of the at least two modules from the plurality of modules.

Example 14. The ear-wearable device of example 13, wherein a first module from the at least two modules is configured to receive a first portion of a dovetail or cross pin from and a second module from the at least two modules is configured to receive a second portion of the dovetail or cross pin.

Example 15. A hearing device comprising: a plurality of modules that mate together forming a physical outer shell of the hearing device, wherein: a first module from the plurality of modules comprises at least one microphone; a second module from the plurality of modules comprises at least one processor; a third module from the plurality of modules comprises a behind-the-ear transducer configured to couple the third module to an in-the-ear component of the hearing device, or is configured to communicate with an in-the-ear transducer of the hearing device; each module from the plurality of modules includes a respective physical portion that comprises a different, corresponding part of the outer shell; and each module from the plurality of modules shares a physical interface with at least one other module from the plurality of modules.

Example 16. The hearing device of example 15, wherein the first module and the second module form, in the physical interface between the first module and the second module, an air gap in the outer shell for receiving sound, the air gap being a first air gap in the outer shell for receiving first sound; and wherein the first module and the second module form, in the physical interface between the first module and the second module, a second air gap in the outer shell for receiving second sound.

Example 17. The hearing device of example 16, wherein the air gap is a first air gap in the outer shell for receiving first sound; wherein the first module and the second module form, in the physical interface between the first module and the second module, a first part of a second air gap in the outer shell for receiving second sound; and wherein the first module and the third module form, in the physical interface between the first module and the third module, a second part of the second air gap in the outer shell for receiving the second sound.

Example 18. A method comprising: identifying, by a processor of a first module from a plurality of modules of an ear-wearable device, each other module from the plurality of modules; adjusting, by the processor, one or more settings of the ear-wearable device based on characteristics of each of the other modules; detecting, by the processor, at least one module from the plurality of modules being replaced with a new module; and automatically adjusting, by the processor, the one or more settings of the ear-wearable device based on characteristics of the new module.

Example 19. The method of example 18, wherein the at least one module from the other modules comprises a behind-the-ear transducer configured to couple the at least one module to an in-the-ear component of the ear-wearable device, and wherein the new module is configured to communicate with an in-the-ear transducer of the ear-wearable device.

Example 20. The method of example 19, wherein the one or more settings of the ear-wearable device comprise a setting that configures the processor to execute different software in response to determining that the new module is configured to communicate with the in-the-ear transducer of the ear-wearable device instead of comprising the behind-the-ear transducer configured to couple the at least one module to the in-the-ear component of the ear-wearable device.

It is to be recognized that depending on the example, certain acts or events of any of the techniques described herein can be performed in a different sequence, may be added, merged, or left out altogether (e.g., not all described acts or events are necessary for the practice of the techniques). Moreover, in certain examples, acts or events may be performed concurrently, e.g., through multi-threaded processing, interrupt processing, or multiple processors, rather than sequentially.

In one or more examples, the functions described may be implemented in hardware, software, firmware, or any combination thereof. If implemented in software, the functions may be stored on or transmitted over, as one or more instructions or code, a computer-readable medium and executed by a hardware-based processing unit. Computer-readable media may include computer-readable storage media, which corresponds to a tangible medium such as data storage media, or communication media including any medium that facilitates transfer of a computer program from one place to another, e.g., according to a communication protocol. In this manner, computer-readable media generally may correspond to (1) tangible computer-readable storage media which is non-transitory or (2) a communication medium such as a signal or carrier wave. Data storage media may be any available media that can be accessed by one or more computers or one or more processing circuits to retrieve instructions, code and/or data structures for implementation of the techniques described in this disclosure. A computer program product may include a computer-readable medium.

By way of example, and not limitation, such computer-readable storage media can comprise RAM, ROM, EEPROM, CD-ROM or other optical disk storage, magnetic disk storage, or other magnetic storage devices, flash memory, cache memory, or any other medium that can be used to store desired program code in the form of instructions or data structures and that can be accessed by a computer. Also, any connection may be considered a computer-readable medium. For example, if instructions are transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. It should be understood, however, that computer-readable storage media and data storage media do not include connections, carrier waves, signals, or other transient media, but are instead directed to non-transitory, tangible storage media. Combinations of the above should also be included within the scope of computer-readable media.

Functionality described in this disclosure may be performed by fixed function and/or programmable processing circuitry. For instance, instructions may be executed by fixed function and/or programmable processing circuitry. Such processing circuitry may include one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated hardware and/or software modules. Also, the techniques could be fully implemented in one or more circuits or logic elements. Processing circuits may be coupled to other components in various ways. For example, a processing circuit may be coupled to other components via an internal device interconnect, a wired or wireless network connection, or another communication medium.

Various components, modules, or units are described in this disclosure to emphasize functional aspects of devices configured to perform the disclosed techniques, but do not necessarily require realization by different hardware units. Rather, as described above, various units may be combined in a hardware unit or provided by a collection of interoperative hardware units, including one or more processors as described above, in conjunction with suitable software and/or firmware.

Various examples have been described. These and other examples are within the scope of the following claims.

What is claimed is:

1. An ear-wearable device comprising:

a plurality of modules that mate together forming a physical outer shell of the ear-wearable device, wherein:

each module from the plurality of modules is associated with a different, corresponding feature of the ear-wearable device;

each module from the plurality of modules includes a respective physical portion that comprises a different, corresponding part of the outer shell;

each module from the plurality of modules shares a physical interface with at least one other module from the plurality of modules;

a particular module from the plurality of modules comprises a processor; and the processor is configured to detect when an existing module from the plurality of modules is replaced with a new module.

2. The ear-wearable device of claim 1, wherein at least one of the plurality of modules comprises at least one microphone.

3. The ear-wearable device of claim 1, wherein at least two modules from the plurality of modules form, in the physical interface between the at least two modules, an inlet in the outer shell for receiving sound, and the respective physical portion of a first module from the at least two modules overlaps some of the respective physical portion of a second module from the at least two modules.

4. The ear-wearable device of claim 3, wherein the inlet comprises an air gap and the at least two modules form the air gap in the outer shell by forming a tunnel, in the physical interface between the at least two modules, that carries air from outside the outer shell to the at least one microphone of the first module or the second module.

5. The ear-wearable device of claim 3, wherein the inlet comprises a first air gap in the outer shell for receiving first sound, and wherein the at least two modules from the plurality of modules further form, in the physical interface between the at least two modules, a second air gap in the outer shell for receiving second sound.

6. The ear-wearable device of claim 1, wherein a particular module from the plurality of modules comprises a behind-the-ear transducer including a receiver and a connection point configured to couple the particular module to an in-ear component of the ear-wearable device.

7. The ear-wearable device of claim 1, wherein a particular module from the plurality of modules is configured to communicate with an in-the-ear transducer of the ear-wearable hearing device.

8. The ear-wearable device of claim 1, wherein the processor is configured to automatically reconfigure the hearing device to enable the new module in response to detecting when the existing module from the plurality of modules is replaced with the new module.

9. The ear-wearable device of claim 1, wherein at least two of the plurality of modules mate together via an electrical interface.

10. The ear-wearable device of claim 9, wherein the electrical interface comprises one or more pins, magnets, or contacts.

11. The ear-wearable device of claim 1, wherein at least two of the plurality of modules mate together via one or more reciprocal slots, dovetails, or cross pins for form-fitting together the respective physical portion of each of the at least two modules from the plurality of modules.

12. The ear-wearable device of claim 11, wherein a first module from the at least two modules is configured to receive a first portion of a dovetail or cross pin from and a second module from the at least two modules is configured to receive a second portion of the dovetail or cross pin.

13. An ear-wearable device comprising:

a plurality of modules that mate together forming a physical outer shell of the ear-wearable device, wherein:

each module from the plurality of modules is associated with a different, corresponding feature of the ear-wearable device;

each module from the plurality of modules includes a respective physical portion that comprises a different, corresponding part of the outer shell;

each module from the plurality of modules shares a physical interface with at least one other module from the plurality of modules;

at least two modules of the plurality of modules form, in the physical interface between the at least two modules, an inlet in the outer shell for receiving sound; and the respective physical portion of a first module of the at least two modules overlaps some of the respective physical portion of a second module of the at least two modules.

14. The ear-wearable device of claim 13, wherein the inlet comprises an air gap and the at least two modules form the air gap in the outer shell by forming a tunnel, in the physical interface between the at least two modules, that carries air from outside the outer shell to the at least one microphone of the first module or the second module.

15. The ear-wearable device of claim 13, wherein the inlet comprises a first air gap in the outer shell for receiving first sound, and wherein the at least two modules from the plurality of modules further form, in the physical interface between the at least two modules, a second air gap in the outer shell for receiving second sound.

16. The ear-wearable device of claim 13, wherein at least one of the plurality of modules comprises at least one microphone.

17. The ear-wearable device of claim 13, wherein a particular module from the plurality of modules comprises a behind-the-ear transducer including a receiver and a connection point configured to couple the particular module to an in-ear component of the ear-wearable device.

18. The ear-wearable device of claim 13, wherein a particular module from the plurality of modules is configured to communicate with an in-the-ear transducer of the ear-wearable hearing device.

19. The ear-wearable device of claim 13, wherein at least two of the plurality of modules mate together via an electrical interface.

20. The ear-wearable device of claim 19, wherein the electrical interface comprises one or more pins, magnets, or contacts.

21. The ear-wearable device of claim 13, wherein at least two of the plurality of modules mate together via one or more reciprocal slots, dovetails, or cross pins for form-fitting together the respective physical portion of each of the at least two modules of the plurality of modules.

22. The ear-wearable device of claim 21, wherein a first module of the at least two modules is configured to receive a first portion of a dovetail or cross pin from and a second module of the at least two modules is configured to receive a second portion of the dovetail or cross pin.

23. The ear-wearable device of claim 1, wherein the processor of the particular module is configured to identify each of the other modules of the plurality of modules.

24. The ear-wearable device of claim 1, wherein the processor of the particular module is configured to adjust one or more settings of the ear-wearable device based on characteristics of other modules of the plurality of modules.

25. The ear-wearable device of claim 1, wherein the processor of the particular module is configured to automatically adjust one or more settings of the ear-wearable device based on characteristics of the new module.

26. The ear-wearable device of claim 1, wherein:

the existing module comprises a behind-the-ear transducer configured to couple the existing module to an in-the-ear component of the ear-wearable device;

the new module is configured to communicate with an in-the-ear transducer of the ear-wearable device;

the processor of the particular module is configured to automatically adjust one or more settings of the ear-wearable device based on characteristics of the new module; and the one or more settings of the ear-wearable device comprise a setting that configures the processor to execute different software in response to determining that the new module is configured to communicate with the in-the-ear transducer of the ear-wearable device instead of comprising the behind-the-ear transducer configured to couple the existing module to the in-the-ear component of the ear-wearable device.

* * * * *